US006302124B1

(12) United States Patent
Demarco

(10) Patent No.: US 6,302,124 B1
(45) Date of Patent: Oct. 16, 2001

(54) UMBRELLA WITH TELESCOPING TUBES, TUBE LATCHING MEANS WITH SPRING URGENCY, AND FABRIC COVER THAT HIDES THE LATCH WHEN COVER IS CLOSED

(76) Inventor: Joseph H. Demarco, 60 Seaman Ave., New York, NY (US) 10034

( * ) Notice: Subject to any disclaimer, the term of this patent is extended or adjusted under 35 U.S.C. 154(b) by 0 days.

(21) Appl. No.: 09/511,287

(22) Filed: Feb. 23, 2000

(51) Int. Cl.[7] ..... A45B 19/00
(52) U.S. Cl. ..... 135/25.1; 135/15.1; 135/33.2
(58) Field of Search ..... 135/33.2, 25.1, 135/15.1, 20.3

(56) References Cited

U.S. PATENT DOCUMENTS 3,680,571 8/1972 Houston .
6,058,952 * 5/2000 Lin et al. ..... 135/29

FOREIGN PATENT DOCUMENTS

4004189-C1 * 4/1991 (DE) ..... 135/25.1

* cited by examiner

*Primary Examiner*—Carl D. Friedman
*Assistant Examiner*—N. Slack
(74) *Attorney, Agent, or Firm*—Myon Amer, P.C.

(57) ABSTRACT

An open spaced apart patio sun umbrella which, when the top thereof is raised, undergoes a reshaping into an inverted v-shape closed condition and makes, to the extent it is raised, the location of an unlatching mechanism within convenient reach of a user making unobserved unlatching contact therewith through the bottom opening of the v-shape, even though the unlatching mechanism is masked from view.

1 Claim, 3 Drawing Sheets

UMBRELLA WITH TELESCOPING TUBES, TUBE LATCHING MEANS WITH SPRING URGENCY, AND FABRIC COVER THAT HIDES THE LATCH WHEN COVER IS CLOSED

The present invention relates generally to improvements for a patio sun umbrella in the use of which relative movement of ascending and descending top and bottom telescoped tubes determine the closed (ascending) and open (descending) conditions of the umbrella, as illustrated and described in U.S. Pat. No. 3,680,571, wherein the improvements more particularly facilitate the transition from the closed to the open condition of the umbrella, all as will be better understood as the description proceeds.

Example of the Prior Art

The '571patent, namely, U.S. Pat. No. 3,680,571 issued for "Umbrella Folding Assembly" to Jack W. Houston on Aug. 1, 1972 exemplifies an operating mode that is not in popular use, wherein the support of the umbrella cover contemplates ascending component movement to be closed and reverse, i.e., descending movement, to be opened. As known by common experience, most umbrellas open by urging a slide on the umbrella vertical support in ascending movement, and urging the slide in descending movement to close the umbrella. Thus the conditions of the umbrella cover are just the reverse as between the umbrellas in popular use and the umbrella exemplified by the '571 patent.

In the umbrella of the '571 patent the full beneficial potential of its operating mode is not realized. In this, and in all other known patents employing the described operating mode, and in particular the descending movement to open the umbrella, the descending movement is achieved under spring urgency. That is, the referred to spring is compressed during ascending movement and in the compressed condition causes the descending movement. Thus, during ascending movement to close the umbrella, a force is required to compress the return spring. Also, the umbrella construction must include provision for the return spring. In the umbrella according to the present invention, the use of a return spring is effectively dispensed with.

Broadly, it is an object of the present invention to provide a patio sun umbrella and method of use thereof which overcomes the foregoing and other shortcomings of the prior art.

More particularly, the opening, of the umbrella is, as noted, of a descending nature and thus is allowed to occur primarily only under the weight of the top of the umbrella, i.e., without return springs or the like, thereby greatly simplifying the construction and use of the umbrella.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
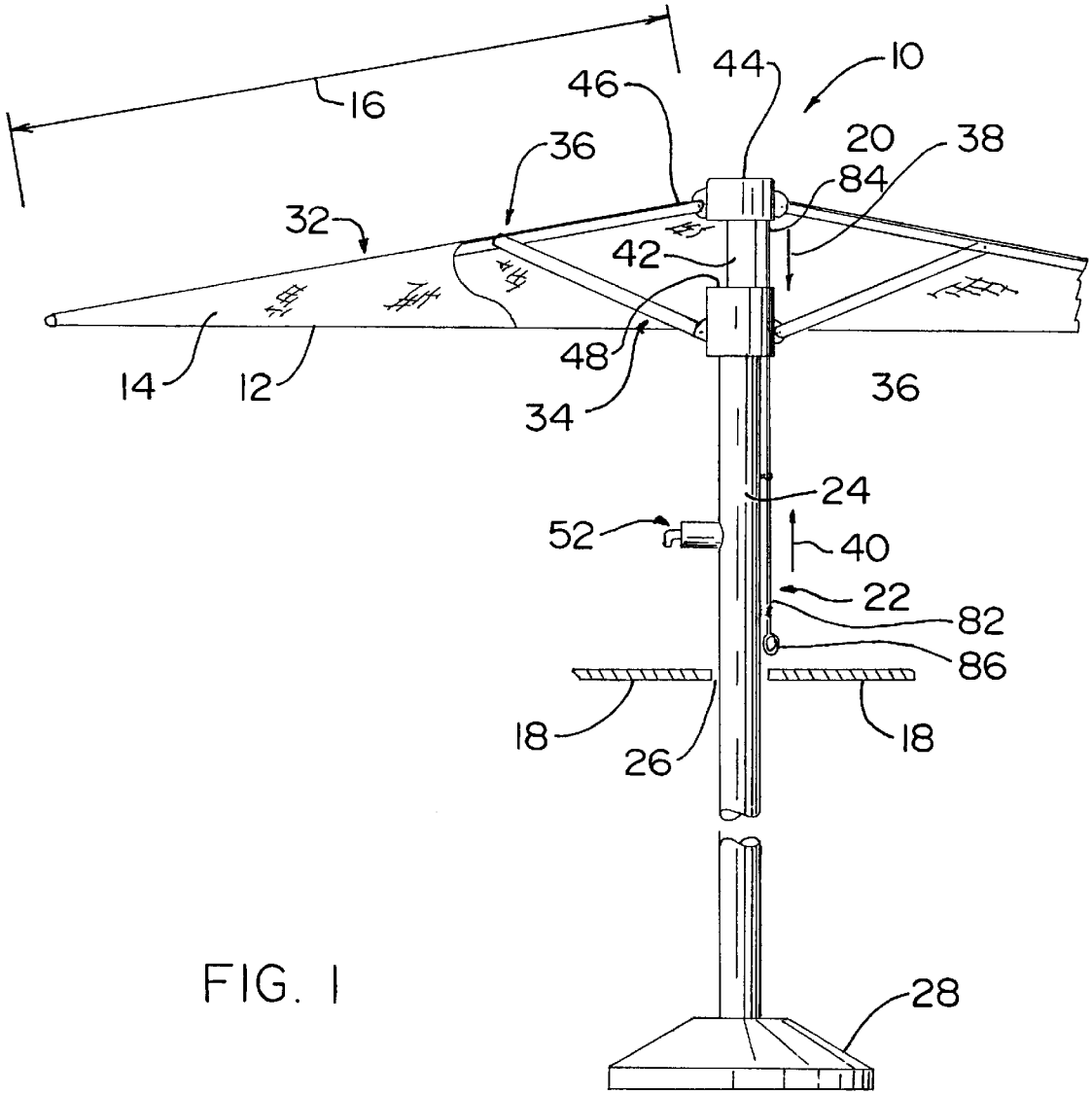
FIG. 1 is a partial side elevational view, drawn in a selected scale, of a patio umbrella according to the present invention in its sun-blocking open condition.

Illustrated in FIG. 1 is a Sun umbrella 10 having a circular sun-blocking cover 12 of fabric construction material which in assuming its circular shape is in its open condition, as noted at 14, in which by virtue of its radial dimension 16 it provides shade to individuals seated about an outdoor patio table 18, and wherein the cover 12 is supported from below at a central location 20 by vertically oriented telescoped tubes, generally designated 22, the stationary tube 24 of which is disposed through a central opening 26 of the patio table 18 and appropriated attached, so as to be held vertically in place, against being lifted by wind gusts or the like, to a stand 28 of metal or stone construction material.

Figure 2:
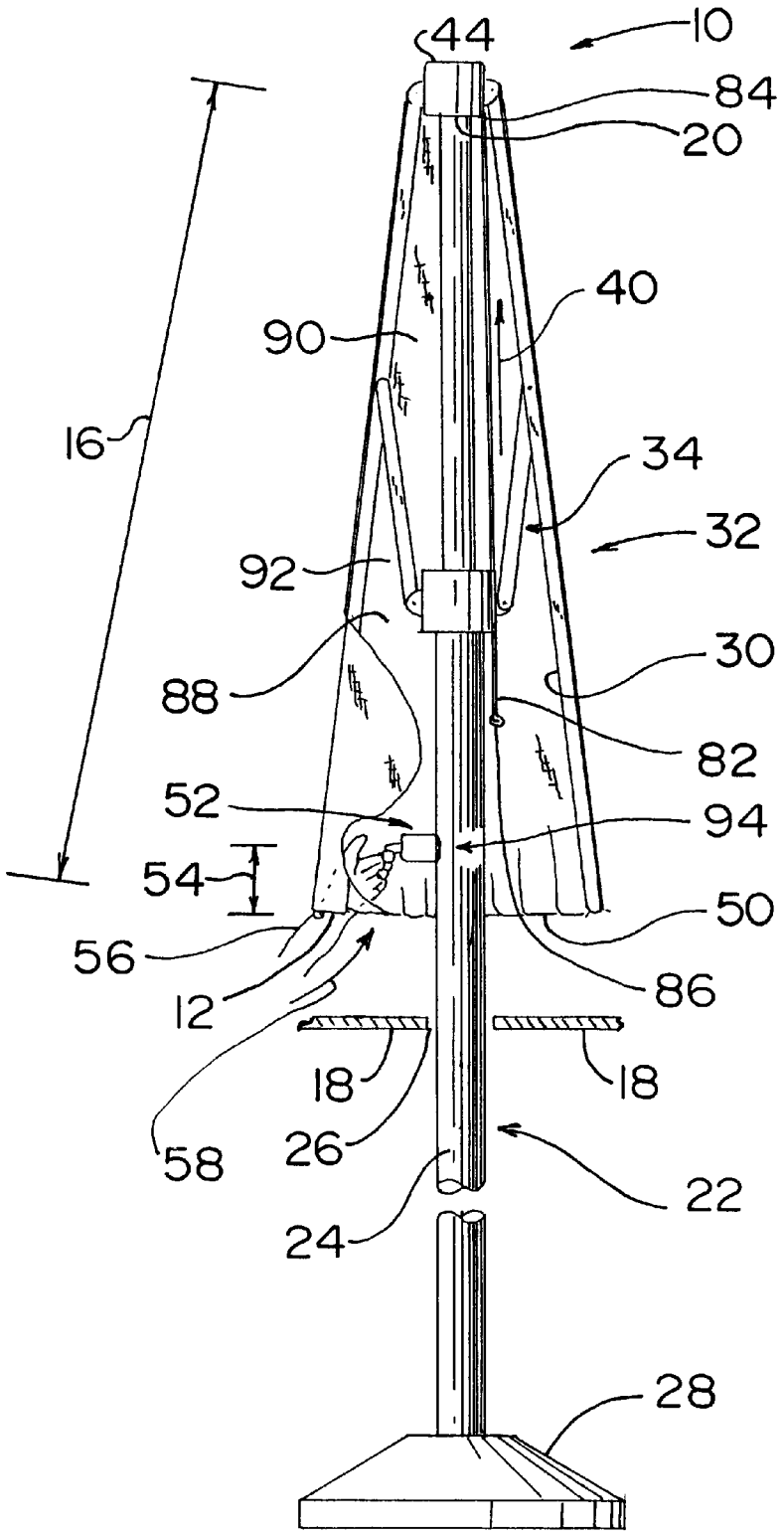
FIG. 2 is similarly a side elevational view, drawn in the same scale, of a patio umbrella in its closed condition.
Figure 3:
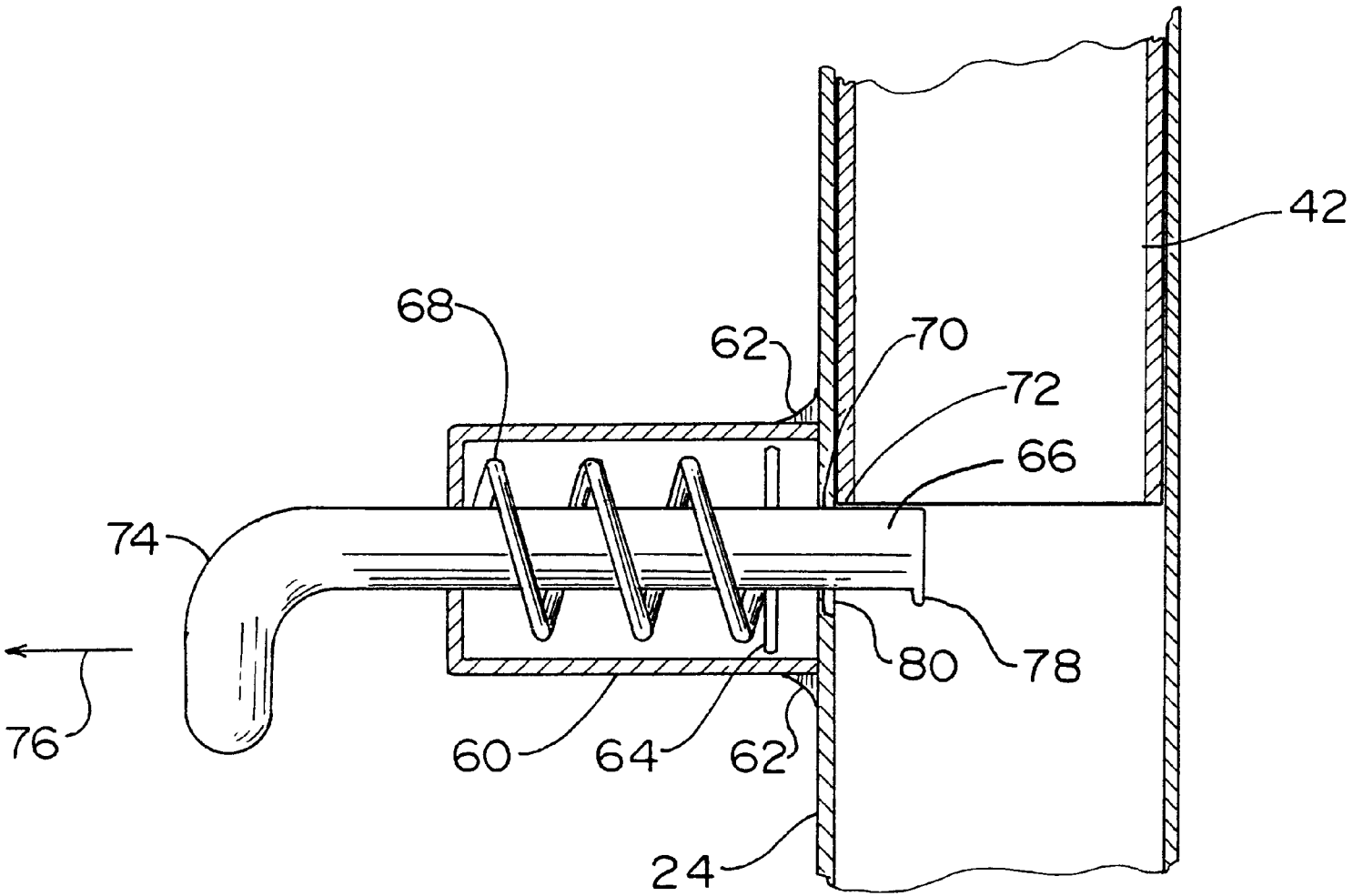
FIG. 3 is an isolated view, on an enlarged scale, of the umbrella latching and unlatching component.

In the closed or storage condition of the umbrella 10 the cover 12 is in an inverted V-shape, as illustrated in phantom perspective in FIG. 2 and noted as at 30, the V-shaped closed condition 30 and the open circular shape condition 14, being responsive, as is well known, to articulation of a circumferentially first array of ribs, individually and collectively designated 32, and a second array of struts, individually and collectively designated 34, said ribs and struts being interconnected to each other at plural sites of pivots, individually and collectively designated 36.

The noted opening and closing operating mode is well known to the extent disclosed in U.S. Pat. No. 3,680,571 issued to Jack W. Houston for "Umbrella Folding Assembly" on Aug. 1, 1972, in that descending movement 38 opens the umbrella and ascending movement 40 closes the umbrella. However, not disclosed in the '571 patent or in any other known patent, is the use to advantage of the motions 38, 40 in contributing greatly to the ease of using the umbrella 10, all as will now be explained in detail.

Cooperating with the stationary lower tube 24 of the vertical support 22 is a slidably disposed, i.e., telescoped, upper tube 42. After descending movement 38 by gravity weight of a bracket 44 provided for the circumferentially spaced pivots 36 at the inner ends 46 of the ribs 32, the bracket 44 seats on the upper edge 48 of the lower tube 24, and this consequently limits the extent of descending movement, and will be understood to be adequate to cause sufficient articulation of the pivotally interconnected ribs and struts to produce the umbrella open condition 14.

In the reverse ascending movement 40, the closed umbrella condition 30 is restored and, even more important to note, the bottom edge 50 of the cover 12 is correspondingly also urged through ascending movement, so that said cover bottom edge 50 is just slightly disposed over a latching/unlatching means 52 the distance 54 therebetween being typically not in excess of 8 inches. At the distance 54 the latching/unlatching means 52 is within convenient reach of a user 56, as noted at 58. Thus, although the latching/unlatching means 52 is masked from view by the 8 inch border just inwardly of the lower edge 50, operation of the latching/unlatching means 52 is readily achieved by touch, which is also guided to the site of touch by feel of the tube 24 during ascending movement 40.

Although an appropriate latching/unlatching means 52 should be well known to those well versed in the art, for completeness' sake good results have been achieved with a construction having a housing 60 welded, as at 62, to the stationary tube 24 and a flanged, as at 64, latching bolt 66 urged in latching movement under the urgency of a spring 68 results in projected relationship of the end of the bolt through aligned openings 70 and 72 in the respective tubes 24 and 42 which is effective in holding the umbrella cover 12 in its closed inverted V-shape configuration. A finger grip 74 is provided on the end of the latching bolt 66 to facilitate reverse direction unlatching movement 76, a movement which is limited by the seating of a radial projection 78 on the end of the bolt 66 in a shoulder recess 80 in the tube 42.

A lifting rod 82 attached at its tipper end 84 to the bracket 44 is manually urged through ascending movement 40 using an accessible end 86 below the cover edge 50 which, as noted, not only changes the open configuration 14 of the cover 12 to its closed configuration 30, but renders accessible for operation the latching/unlatching means 52, an accessibility made practical by the distance or extent of ascending movement of the cover lower edge 50, and without which the latching/unlatching means 52 could not be conveniently reached under the cover 12. Stated somewhat differently, the inverted V-shape 30 bounds an internal compartment 88 having an upper portion 90, which is beyond convenient reach from beneath the cover edge 50. However, the reach 58 is approximately half the distance to the top of the compartment lower portion 92 and, as noted, this lower portion 92 is the site 94 of attachment of the latching/unlatching means 52 to thereby provide accessibility 58 to the latching/unlatching means 52 even though it is blocked or masked from view by the closed position of the umbrella 10.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A patio sun umbrella comprising an umbrella cover of fabric construction material in a circular shape having a center, a peripheral edge, and a radial dimension of a size effective in a spread apart open condition to provide optimum shade in an outdoor sunny environment, a cooperating assembly of an upper hollow movable tube having a top and an operative position in a telescoped relation to a bottom hollow stationary tube serving in said assembly as a vertically oriented support operatively effective to support said umbrella cover from beneath said center thereof, cooperating circumferentially spaced apart arrays of ribs and struts pivotally interconnected to each other and to said upper and bottom tubes to impart open and closed conditions to said umbrella cover supported on said ribs and struts, a selected first dimension of said ribs as measured from said top of said upper tube to a free end of said ribs effective to provide said closed condition of said umbrella cover as an inverted V-shape bounding an interior compartment in surrounding relation about said telescoped movable and stationary tubes tube-latching means for latching under spring urgency and manually unlatching said telescoped tubes incident to permitting unrestrained relative movement therebetween, means urging said movable top tube in ascending movement of a specified extent effective to allow said interconnected ribs and struts to cause said inverted V-shaped closed condition thereof about said telescoped tubes within said interior compartment, and a selected site of attachment of said tube-latching means on said stationary bottom tube at a second dimension as measured from said top of said upper tube to said site, said first dimension selected to be greater than said second dimension so that in said closed condition of said umbrella cover supported on said ribs said umbrella cover is in covering relation over said tube-latching means to serve as a weather barrier without impeding a convenient reach of a user's arm being inserted beneath said umbrella cover preparatory to manually implementing said unlatching function of said tube-latching means.

* * * * *